United States Patent [19]

Schneider et al.

[11] Patent Number: 4,729,768

[45] Date of Patent: Mar. 8, 1988

[54] DELIMING OF HIDES AND USE OF CYCLIC ESTERS OF SULFUROUS ACID AS DELIMING AGENTS

[75] Inventors: Kurt Schneider, Bad Durkheim; Dietrich Lach, Friedelsheim; Rolf Streicher, Worms; Ortwin Schaffer, Ludwigshafen, all of Fed. Rep. of Germany

[73] Assignee: BASF Aktiengesellschaft, Ludwigshafen, Fed. Rep. of Germany

[21] Appl. No.: 886,683

[22] Filed: Jul. 18, 1986

[30] Foreign Application Priority Data

Jul. 27, 1985 [DE] Fed. Rep. of Germany ..... 3527013

[51] Int. Cl.[4] ..... C14C 1/00

[52] U.S. Cl. ..... 8/94.18; 8/94.15; 8/94.16

[58] Field of Search ..... 8/94.18, 94.19 R, 94.33, 8/94.17, 94.15

[56] References Cited

U.S. PATENT DOCUMENTS 4,078,888 3/1978 Arbir et al. ..... 8/94.18
4,213,760 7/1980 Hahn et al. ..... 8/94.17

FOREIGN PATENT DOCUMENTS 0059909 2/1984 European Pat. Off. .

*Primary Examiner*—Paul Lieberman
*Assistant Examiner*—John F. McNally
*Attorney, Agent, or Firm*—Oblon, Fisher, Spivak, McClelland & Maier

[57] ABSTRACT

In a particularly time-saving and economical process for deliming hides, a cyclic ester of sulfurous acid with an aliphatic 1,2-diol is used as the deliming agent.

8 Claims, No Drawings

DELIMING OF HIDES AND USE OF CYCLIC ESTERS OF SULFUROUS ACID AS DELIMING AGENTS

The present invention relates to a particularly time-saving and economical process for deliming hides with cyclic esters of sulfurous acid with an aliphatic 1,2-diol, and to the use of these esters as deliming agents.

Hides are unhaired and otherwise prepared in the course of leather manufacture by liming in alkali medium, usually with the aid of inorganic or, alternatively, organic sulfides. The alkaline agent is normally lime itself, which is generally used alone, but occasionally also mixed with sodium hydroxide or sodium carbonate. As preparation for further processing, the hide material must subsequently be freed from the liming chemicals, in particular the lime itself, ie. must be delimed. This is customarily done with acids or acid salts or, for example as described in DE-C-2,825,081, with esters which hydrolyze under the deliming conditions.

The conditions are customarily liquor lengths of from 0 to 300%, preferably from 0 to 200%, on weight of pelt; temperatures of from 5° to 38° C., preferably from 25° to 35° C.; a liquor pH at the end of deliming of from 6 to 8.7; and deliming times of from 1 to 6, preferably from 1 to 3, hours.

The serious disadvantages of acid deliming processes are due to the fact that the liquor can be at below pH 5 at the start of deliming, as a consequence of which any protein substances which have gone into solution in the course of liming can in certain circumstances be precipitated with other substances, and hydrogen sulfide escapes in such amounts that it is frequently possible to measure $H_2S$ concentrations of 2000 ppm or more above the deliming liquors.

European Pat. No. 59,909 discloses using 5- or 6-ring-membered cyclic carbonates of a polyhydric aliphatic alcohol, for example ethylene carbonate or 1,2-propylene carbonate, as deliming agents, where in use the liquor does not drop below pH 7.5 and the development of gaseous hydrogen sulfide is substantially avoided.

The disadvantage of this process is that the cyclic carbonates hydrolyze relatively slowly in the deliming process, so that pelts which are around 4.5 mm in thickness require at least 2 hours for complete deliming, which in some instances is too long for practical use.

The deliming of unsplit pelts over 4.5 mm, for example of from 5 to 7 mm, in thickness takes too long for the use of cyclic carbonates to be economical.

It is true that under the process conditions described in European Pat. No. 59,909 the amount of gaseous hydrogen sulfide which escapes from the deliming liquor is smaller than in the case of acid deliming agents or in the case of the esters mentioned in DE-C-2,825,081. However, the disadvantage is that the hydrogen sulfide is present at the end of deliming in dissolved form. If, as is frequently done in the field, this liquor is combined with acidic waste waters, large amounts of gaseous hydrogen sulfide are produced, which can become a marked nuisance or even hazard. In addition, a noticeable amount of hydrogen sulfide is also evolved from the delimed pelt material in the subsequent pickling process as a result of the supply of acid.

It is an object of the present invention to provide for an efficient deliming process a deliming agent which obviates the disadvantages mentioned.

We have found that this object is achieved with a process for deliming hides under otherwise customary deliming conditions with respect to liquor length, temperature and liquor pH by using as the active deliming agent a compound of the formula I

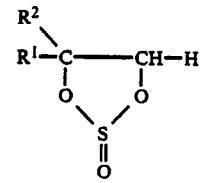

where $R^1$ is hydrogen or saturated alkyl of 1 to 4 carbon atoms which can be substituted by chlorine, and $R^2$ is hydrogen or methyl.

The deliming according to the invention goes to completion within from 30 minutes to 4 hours, so that by means of the invention it is frequently surprisingly possible to halve the deliming times compared with the cyclic carbonates described. In general, the deliming of split cattle pelts of from 4 to 4.5 mm in thickness is complete within from 60 to 90 minutes. It was also found, surprisingly, that despite a low pH the concentration of gaseous hydrogen sulfide at the end of the deliming process is not found to be higher, although a higher concentration is what would have been expected from a somewhat lower pH range.

It was also found, surprisingly, that on using the new deliming agent the delimed pelts, unlike the processes described in European Pat. No. 59,909, do not evolve hydrogen sulfide on the supply of acid in the pickling process following deliming. In addition, the amount of hydrogen sulfide found in the deliming liquor on using the deliming agent according to the invention is only about ¼ to 1/5 the amount found with the cyclic carbonates.

For the purposes of the present invention, alkyl radicals of 1 to 4 carbon atoms are saturated, straight-chain or branched aliphatic radicals which can be substituted by a chlorine atom. Of these, methyl and ethyl are particularly preferred.

$R^1$ and $R^2$ are particularly preferably hydrogen and methyl.

The compounds of the formula (I) are cyclic esters of sulfurous acid with an aliphatic 1,2-diol. The compounds of the formula I are known or can be prepared in a conventional manner, for example by reacting sulfur dioxide with an appropriate epoxide.

Examples of compounds of the formula I are: ethylene glycol sulfite, propylene glycol sulfite, 1,2-butylene glycol sulfite, isobutylene glycol sulfite and the cyclic ester of epichlorohydrin and sulfur dioxide.

Preferred compounds are ethylene glycol sulfite and propylene glycol sulfite.

The general deliming conditions under which the deliming agent of the invention is to be used conform to those customary in the field:

Conventionally limed hides, for example cattle flanks and sheep and goat hides, are used. In general, limed and split cattle hides which are for example from 2.5 to 4.5 mm in split thickness and which after liming have been washed for example by drumming with water are used. Unsplit pelts are for example from about 5 to 7 mm and sheep and goat hides from 1 to 3 mm in thickness.

Expedient conditions for the deliming according to the invention are liquor lengths of from 0 to 300%, on weight of pelt, temperatures of from 5° to 38° C. and a pH range of from 6 to 8.7. The preferred ranges are: liquor lengths from 0 to 200%, temperatures from 25° to 32° C. and a pH from 6 to 7.5.

The compounds of the formula I which are to be used according to the invention are expediently used in an amount of from 0.5 to 3%, preferably from 1 to 2%, on weight of pelt.

The compounds of the formula I are liquid and are expediently added directly or in the form of an aqueous solution. Insufficiently water-soluble compounds of the formula I can be emulsified or dispersed in a conventional manner with cationic, anionic or nonionic emulsifiers. The emulsifying or dispersing does not present any problems.

While in the deliming process of European Pat. No. 59,909, using a cyclic carbonate, the pH is never below 7.5 and the hydrolysis ceases at a pH within the range from 7.8 to 7.5 (cf. page 3, line 4 et seq.), the deliming agent according to the invention gives complete deliming at a final pH of 6–7 without incurring a higher $H_2S$ concentration as a result.

The deliming agents according to the invention can also be used in mixtures with other customary deliming agents, for example the abovementioned cyclic carbonates, in particular ethylene carbonate and propylene carbonate, esters of formic acid, boric acid, ammonium salts or ammonium sulfate.

If mixtures of different deliming agents are used, delimings together with ethylene carbonate, propylene carbonate or ethylene glycol formate are preferred. In this case it is advantageous to use mixtures of a cyclic sulfite of the formula I and one of the abovementioned cyclic carbonates, in which from 10 to 50% by weight of the cyclic sulfite of the formula I have been replaced by a cyclic carbonate. These mixtures are likewise advantageously used in an amount of from 0.5 to 3%, preferably from 1 to 2%, on weight of pelt.

The parts and percentages in the examples are by weight.

EXAMPLE 1

110 parts of limed cattle flanks of from 4 to 4.5 mm in split thickness are first washed for 15 minutes with 330 parts of water at 35° C. by drumming. The wash liquor is then discarded. To the washed pelts in the same drum are then added 110 parts of water at 35° C., followed by 2.2 parts of propylene glycol sulfite. After 5 minutes of drumming the liquor is found to be at pH 6.9. 30 minutes after addition of the deliming agent the liquor has a pH of 7.2 and the degree of deliming is 60%. 30 minutes later the pH is 7.1 and the pelts are 75% delimed. After a further 30 minutes deliming is complete, and the final pH is 7.

COMPARATIVE EXAMPLE 1

In parallel with Example 1, 2.2 parts of propylene carbonate are used under the same conditions as deliming agent. After 5 minutes the liquor has a pH of 8.1 and the degree of deliming is 10%. After 3 hours deliming is complete and the final pH is 8.4.

The illustrative and comparative Examples below are likewise carried out in accordance with Example 1. All the results are given in Table 1.

TABLE 1

| Parts Deliming agent | Example 1 2.2 Propylene glycol sulfite | Comparative Example 1 2.2 Propylene carbonate | Example 2 2.2 Ethylene glycol sulfite | Comparative Example 2 2.2 Ethylene carbonate |
|---|---|---|---|---|
| Degree of deliming after | | | | |
| 30 min | 60% | 10% | 70% | 10% |
| 60 min | 75% | 30% | 80% | 70% |
| 90 min | 100% | 60% | 100% | 50% |
| 120 min | — | 80% | — | 70% |
| 180 min | — | 100% | — | 100% |
| pH after | | | | |
| 5 min | 6.9 | 8.1 | 7.0 | 8.0 |
| 10 min | 7.0 | 8.3 | 7.1 | 8.1 |
| 20 min | 7.1 | 8.2 | 7.2 | 8.2 |
| 30 min | 7.2 | 8.5 | 7.3 | 8.2 |
| 60 min | 7.1 | 8.4 | 7.2 | 8.2 |
| 90 min | 7.1 | 8.4 | 7.1 | 8.2 |
| 120 min | 7.0 | 8.4 | 7.0 | 8.2 |
| 180 min | 7.0 | 8.4 | 7.0 | 8.2 |

EXAMPLE 3

Analogously to Example 1, 1100 parts of limed cattle flanks of from 5 to 5.5 mm in split thickness are delimed with 1100 parts of aqueous liquor by adding 22 parts of ethylene glycol sulfite. The pH of the liquor is 6.6 at the start and 6.1 after 3 hours. The gas space above the liquor in the drum is found to have a hydrogen sulfide concentration of 400 ppm.

COMPARATIVE EXAMPLE 3A

Parallel to Example 3, the deliming of 1100 parts of cattle flanks of equal split thickness is carried out in 1100 parts of aqueous liquor by adding 22 parts of the ethylene glycol formate mentioned in Example 1 of DE-C-2,825,081. The starting pH is 6.7. After 3 hours the hydrogen sulfide concentration in the gas space above the liquor at pH 6.4 is found to be far above 2000 ppm.

COMPARATIVE EXAMPLE 3B

Parallel to Example 3 and Comparative Example 3A, deliming is effected with 22 parts of ethylene carbonate. The starting pH is 7.6. After 3 hours the deliming is complete. The final pH is 7.5; the hydrogen sulfide concentration above the liquor is found to be 800 ppm.

The residual deliming liqours obtained in Example 3 and Comparative Examples 3A and 3B are assayed for sulfide.

The delimed pelts obtained in Example 3 and Comparative Examples 3A and 3B are washed for 2 minutes in 5000 parts of water at 25° C. and are then pickled for 25 minutes in the drum with 1000 parts in each case of pickling liquor (mixture of formic acid, sulfuric acid and sodium chloride) at pH 0.5. At the end the pickling liquor pH is 2.7. Subsequently the hydrogen sulfide concentration in the gas space above the pickling liquor is determined.

All the results of the hydrogen sulfide determinations in the deliming and pickling process are given in Table 2.

TABLE 2

| | | Example 3 | Comparative Example 3A | Comparative Example 3B |
|---|---|---|---|---|
| | Parts | 22 | 22 | 22 |
| | Deliming liquor | Ethylene glycol sulfite | Ethylene glycol formate | Ethylene carbonate |
| Deliming process | Starting pH | 6.6 | 6.7 | 7.6 |
| | Final pH | 6.1 | 6.4 | 7.5 |
| | $H_2S$ concentration in gas space | 400 ppm | >2000 ppm | 800 ppm |
| | Sulfide content of residual liquor | 18.7 mg $H_2S$/l | 20.4 mg $H_2S$/l | 90.1 mg $H_2S$/l |
| Pickling process | $H_2S$ concentration in gas space | 0 ppm | 400 ppm | 250 ppm |

The numerical values show that the hydrogen sulfide concentrations are significantly reduced in the deliming process itself not only in the gas space above the liquor but also in the residual liquor and even in the pickling process.

We claim:

1. A process for deliming limed hides, which comprises:

deliming hides, which have been treated with lime, with a compound of formula (I):

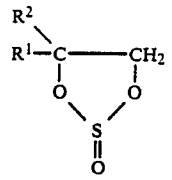

wherein $R^1$ is hydrogen, saturated alkyl of 1 to 4 carbon atoms or chlorosubstituted alkyl of 1 to 4 carbon atoms, and $R^2$ is hydrogen or methyl.

2. The process of claim 1, wherein said deliming agent is a compound selected from the group consisting of ethylene glycol sulfite, propylene glycol sulfite, 1,2-butylene glycol sulfite, isobutylene glycol sulfite and the cyclic ester of epichlorohydrin and sulfur dioxide.

3. The process of claim 2, wherein said deliming agent is ethylene glycol sulfite or propylene glycol sulfite.

4. The process of claim 1, wherein said deliming is conducted as a liquor length of from 0 to 300% on weight of pelt at a temperature ranging from 5°-38° C. and at a pH ranging from 6-8.7, with the amount of said deliming agent ranging from 0.5-3%, based on the weight of pelt.

5. The process of claim 4, wherein the pH during deliming ranges from 6-7.5.

6. The process of claim 4, wherein the liquor length ranges from 0-200%.

7. The process of claim 4, wherein the temperature ranges from 25°-32° C.

8. The process of claim 4, wherein the amount of said deliming agent ranges from 1-2%, based on the weight of pelt.

* * * * *